US005117902A

United States Patent [19]

Kusuhara et al.

[11] Patent Number: 5,117,902

[45] Date of Patent: Jun. 2, 1992

[54] FIN TUBE HEAT EXCHANGER

[75] Inventors: Hisao Kusuhara, Kyoto; Shoichi Yokoyama, Shiga; Hachiro Koma, Kusatsu; Kaoru Kato, Otsu, all of Japan

[73] Assignees: Matsushita Electric Industrial Co., Ltd.; Matsushita Refrigeration Company, both of Osaka, Japan

[21] Appl. No.: 728,810

[22] Filed: Jul. 5, 1991

Related U.S. Application Data

[63] Continuation of Ser. No. 473,399, Feb. 1, 1990, abandoned.

[30] Foreign Application Priority Data

Feb. 1, 1989 [JP] Japan ..... 1-22881

[51] Int. Cl.[5] ..... F28D 1/04

[52] U.S. Cl. ..... 165/151; 165/152

[58] Field of Search ..... 165/151, 152

[56] References Cited

U.S. PATENT DOCUMENTS

| | | | |
|---|---|---|---|
| 4,691,768 | 9/1987 | Obosu | 165/151 |
| 4,723,599 | 2/1988 | Hanson | 165/151 |
| 4,723,600 | 2/1988 | Yokoyama et al. | 165/151 |
| 4,787,442 | 11/1988 | Esformes | 165/151 |
| 4,832,117 | 5/1989 | Kato et al. | 165/151 |
| 4,907,646 | 3/1990 | Aoyagi et al. | 165/151 |

FOREIGN PATENT DOCUMENTS

| | | | |
|---|---|---|---|
| 82690 | 5/1982 | Japan | 165/151 |
| 162134 | 8/1985 | Japan | 165/151 |
| 61-202092 | 9/1986 | Japan . | |
| 61-259093 | 11/1986 | Japan . | |
| 62-26494 | 2/1987 | Japan . | |
| 62-190393 | 8/1987 | Japan . | |

*Primary Examiner*—John Rivell
*Assistant Examiner*—L. R. Leo
*Attorney, Agent, or Firm*—Wenderoth Lind & Pollack

[57] ABSTRACT

A fin tube heat exchanger is used in an air conditioner or the like and comprised of a plurality of fin plates spaced at regular intervals in parallel with one another, a plurality of heat exchanger tubes arranged in at least one row and extending through the fin plates in a direction perpendicular to the direction in which the fin plates extend, a plurality of raised strips formed on each fin plate in a direction perpendicular to an air flow and raised out of their original plane, and at least one draining passage formed on each fin plate and extending along the center line of the row of the heat exchanger tubes. In this heat exchanger, air is allowed to flow between the fin plates whereas a fluid medium is allowed to pass in the heat exchanger tubes. Each raised strip has two leg portions inclined with respect to the direction of the air flow. Furthermore, the raised strips in one row near to a longitudinal edge of the fin plate are increased in number as compared with those in another row near to the center line of the row of the heat exchanger tubes. No raised strip is formed in the draining passage.

1 Claim, 5 Drawing Sheets

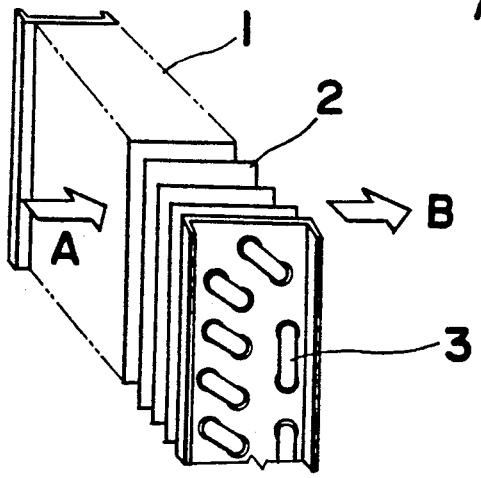
Fig. 1
PRIOR ART
Fig. 2a PRIOR ART
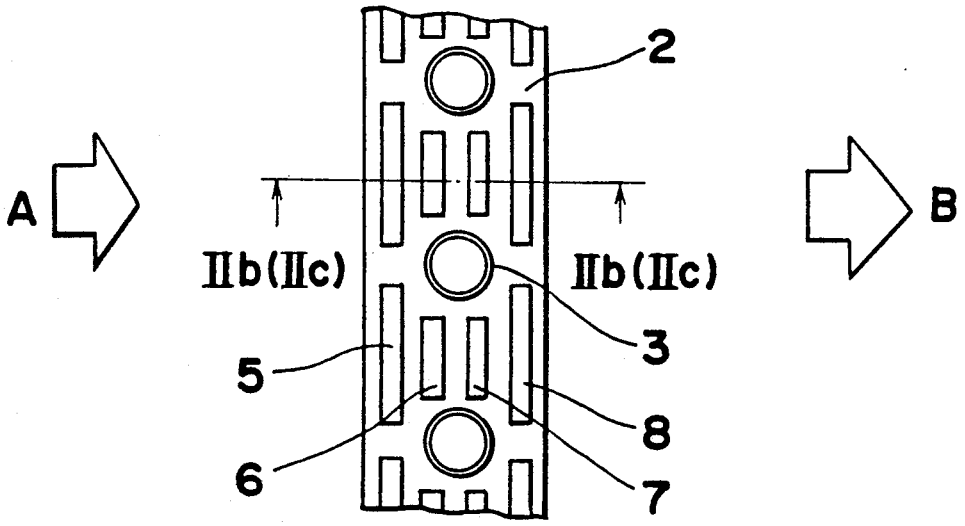
Fig. 2b
PRIOR ART
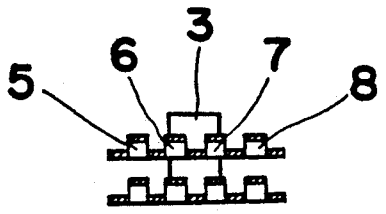
Fig. 2c
PRIOR ART
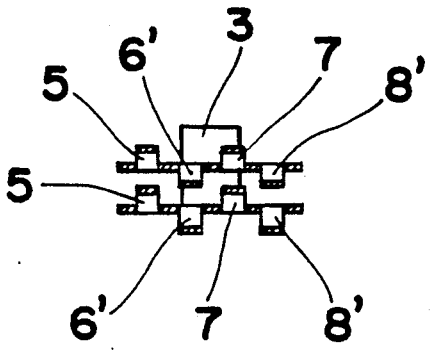

FIN TUBE HEAT EXCHANGER

This application is a continuation of now abandoned application Ser. No. 07/473,399 filed on Feb. 1, 1991.

BACKGROUND OF THE INVENTION

1. Field of the Invention

The present invention generally relates to a heat exchanger, and more particularly, to a fin tube heat exchanger for use in an air conditioner or the like.

2. Description of the Prior Art

FIG. 1 depicts a conventional fin tube heat exchanger.

As shown in FIG. 1, a heat exchanger 1 is provided with a plurality of fin plates 2 of aluminum spaced at regular intervals and a plurality of heat exchanger tubes 3 extending through the fin plates 2. The heat exchanger tubes 3 are securely held in openings formed in the fin plates 2 by any suitable means. Each fin plate 2 has a plurality of narrow cut-out strips extending across the direction of flow. These strips are raised from the plane in which the fin plate 2 lies for raising the heat exchanging performance.

Japanese Patent Publication No. 63-11597 discloses a configuration of such raised strips as shown in FIGS. 2*a* to 2*c*. Raised strips 5–8 or 5–58' extend in a direction perpendicular to the direction of air flow shown by arrows A and B. The raised strips 5–8 are formed on the same side of each fin plate 2 in FIG. 2*b* whereas the raised strips 5–8' are formed alternately on both sides of each fin plate 2 in FIG. 2*c*.

In the case of the raised strips 5–8 as shown in FIG. 2*b*, water drops tend to stay between adjacent raised strips.

On the other hand, in the case of the raised strips 5–8' as shown in FIG. 2*c*, water drops tend to stay substantially in the form of a bridge between adjacent raised strips 5–8'.

In either case, water drops do not drop from the fin plate 2 until they grow into a considerable size.

Japanese Patent Laid-open Application No. 48-58434 discloses another configuration of raised strips as shown in FIGS. 3*a* to 3*c*. Similar to the heat exchanger disclosed in the foregoing Publication, raised strips 9–14 or 9–14' extend in a direction perpendicular to the direction of air flow shown by arrows A and B. The raised strips 9–14 are formed on the same side of each fin plate 2 in FIG. 3*b* whereas the raised strips 9–14' are formed alternately on both sides of each fin plate 2 in FIG. 3*c*. In the same fashion as disclosed in the foregoing Publication, water drops tend to stay between adjacent raised strips 9–14 or 9–14'. In this case, however, since each fin plate 2 is provided with a draining passage 15 along the center line of a row of heat exchanger tubes 3, not as many water drops remain as compared with the strip pattern as shown in FIGS. 2*a* to 2*c*, but the heat exchanging performance is still lowered.

SUMMARY OF THE INVENTION

Accordingly, the present invention has been developed with a view to substantially eliminate the above described disadvantages inherent in the prior art fin tube heat exchangers, and has for its essential object to provide an improved fin tube heat exchanger in which the flow resistance during evaporation is reduced and the heat exchanging performance is raised.

Another important object of the present invention is to provide a fin tube heat exchanger of the above-described type which has a simple structure and can be readily manufactured at a low cost.

In accomplishing these and other objects, a fin tube heat exchanger according to one preferred embodiment of the present invention comprises a plurality of fin plates spaced at regular intervals and parallel with one another, a plurality of heat exchanger tubes arranged in at least one row and extending through the fin plates in a direction perpendicular to the direction in which the fin plates extend, a plurality of raised strips formed on each fin plate in a direction perpendicular to the direction of air flow and raised from the plane in which the fin plate lies, and at least one draining passage formed on each fin plate and extending along at least one portion of the center line of the row of the heat exchanger tubes.

In the fin tube heat exchanger, air flows between the fin plates whereas a fluid medium passes in the heat exchanger tubes.

A greater number of raised strips are provided in one row near a longitudinal edge of the fin plate than in another row nearer to the center line of the row of the heat exchanger tubes. Each raised strip has two leg portions inclined with respect to the direction of air flow.

Furthermore, no raised strip is formed in the draining passage.

According to another aspect of the present invention, a fewer number of the raised strips are provided between two adjacent heat exchanger tubes at a lower portion of each fin plate than at an upper portion of each fin plate.

According to a further aspect of the present invention, the draining passage extends along the center line of the row of heat exchanger tubes except at a space defined between the upper two heat exchanger tubes.

According to still a further aspect of the present invention, the raised strips between two adjacent heat exchanger tubes at a lower portion of each fin plate includes one raised strip located near the center line of the row of the heat exchanger tubes and a plurality of draining passages are formed on both sides of such a raised strip.

The heat exchanger having the above-described structure provides the following effects when used as an evaporator.

Water drops adhering to each fin plate are liable to be directed to the center of the fin plate by forming the draining passage at a central portion of each fin plate and by inclining the leg portions of each raised strip with respect to the direction of air flow.

Furthermore, the novel strip pattern, in which the raised strips are formed closer at the upper portion than at the lower portion of each fin plate, causes water drops to readily drop along the fin plate and reduces the flow resistance. Accordingly, the extreme reduction of the heat exchanging performance which is primarily caused by the reduction in air quantity can be prevented.

In addition, the comparatively wide draining passages between the rows of strips reduces the generation of water drops in the form of a bridge. This fact further reduces the flow resistance and raises the heat exchanging performance.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein:

FIG. 1 is a perspective view of a conventional fin tube heat exchanger;

FIG. 2*a* is a front view of a conventional fin plate mounted in the heat exchanger of FIG. 1;

FIGS. 2*b* and 2*c* are sectional views taken along the lines II*b*--II*b* and II*c*-II*c* in FIG. 2*a*, respectively, illustrating two typical examples of raised strips formed on the fin plate;

DETAILED DESCRIPTION OF THE PREFERRED EMBODIMENTS

It is initially noted that a fin tube heat exchanger according to the present invention has an external appearance to that of the conventional fin tube heat exchanger as shown in FIG. 1.

Similar to the conventional fin tube heat exchanger, a heat exchanger of the present invention is provided with a plurality of fin plates spaced at regular intervals and a plurality of heat exchanger tubes extending through the fin plates. The heat exchanger tubes are securely held in openings formed in the fin plates. Each fin plate has into a plurality of cut-out narrow strips extending across the direction of air flow. These strips are raised from the plane in which the fin plate lies for raising the heat exchanging performance.

Figure 3A:
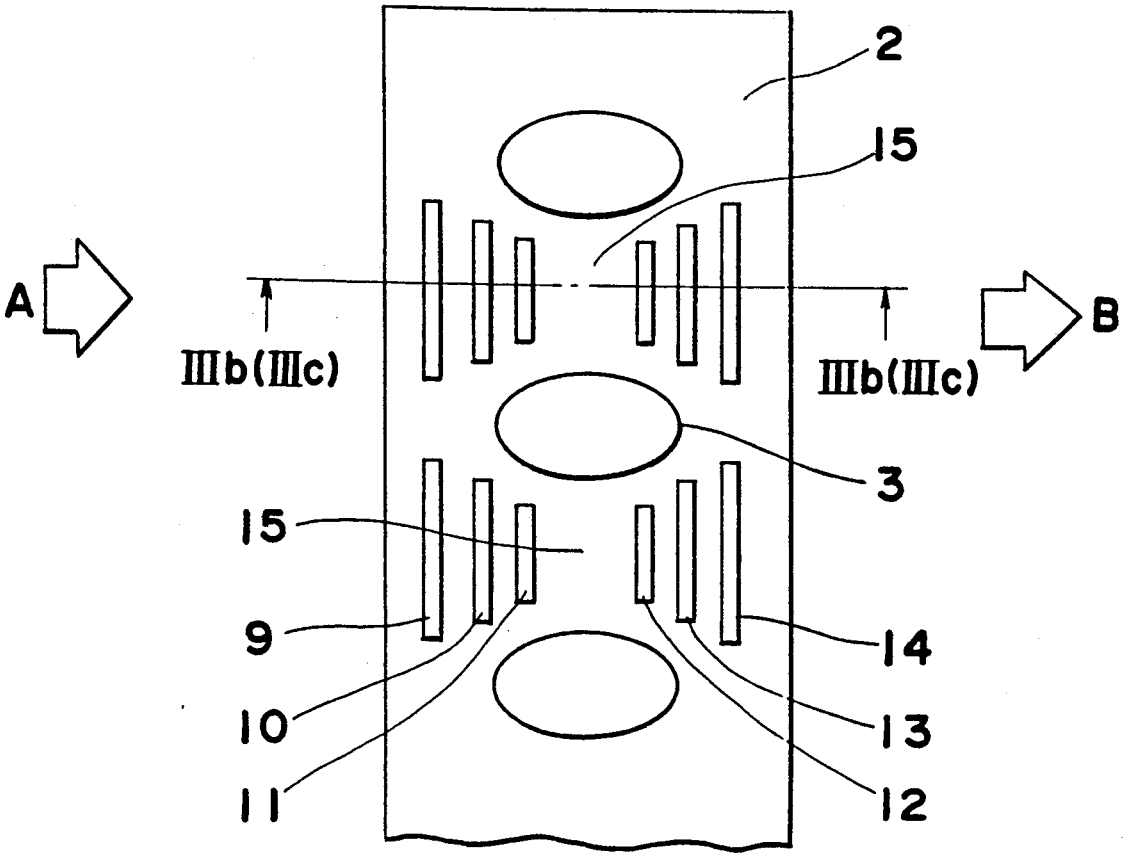
Fig. 3a PRIOR ART
FIG. 3*a* is a front view of another conventional fin plate.
Figure 3B:
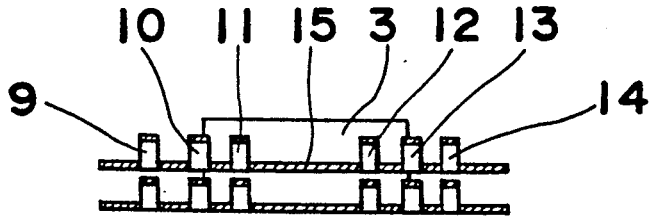
Fig. 3b PRIOR ART
FIGS. 3*b* and 3*c* are sectional views taken along the lines III*b*-III*b* and III*c*-III*c* in FIG. 3*a*, respectively, indicating two typical examples of the raised strips.
Figure 3C:
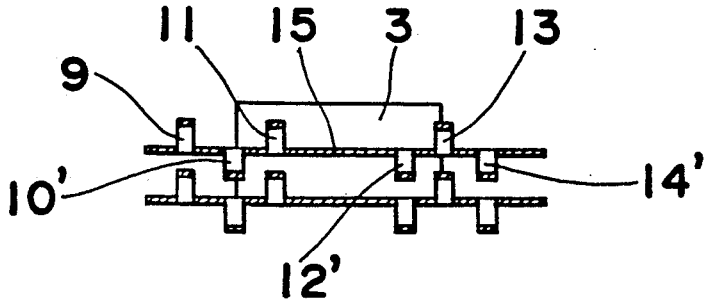
Fig. 3c PRIOR ART
Figure 4A:
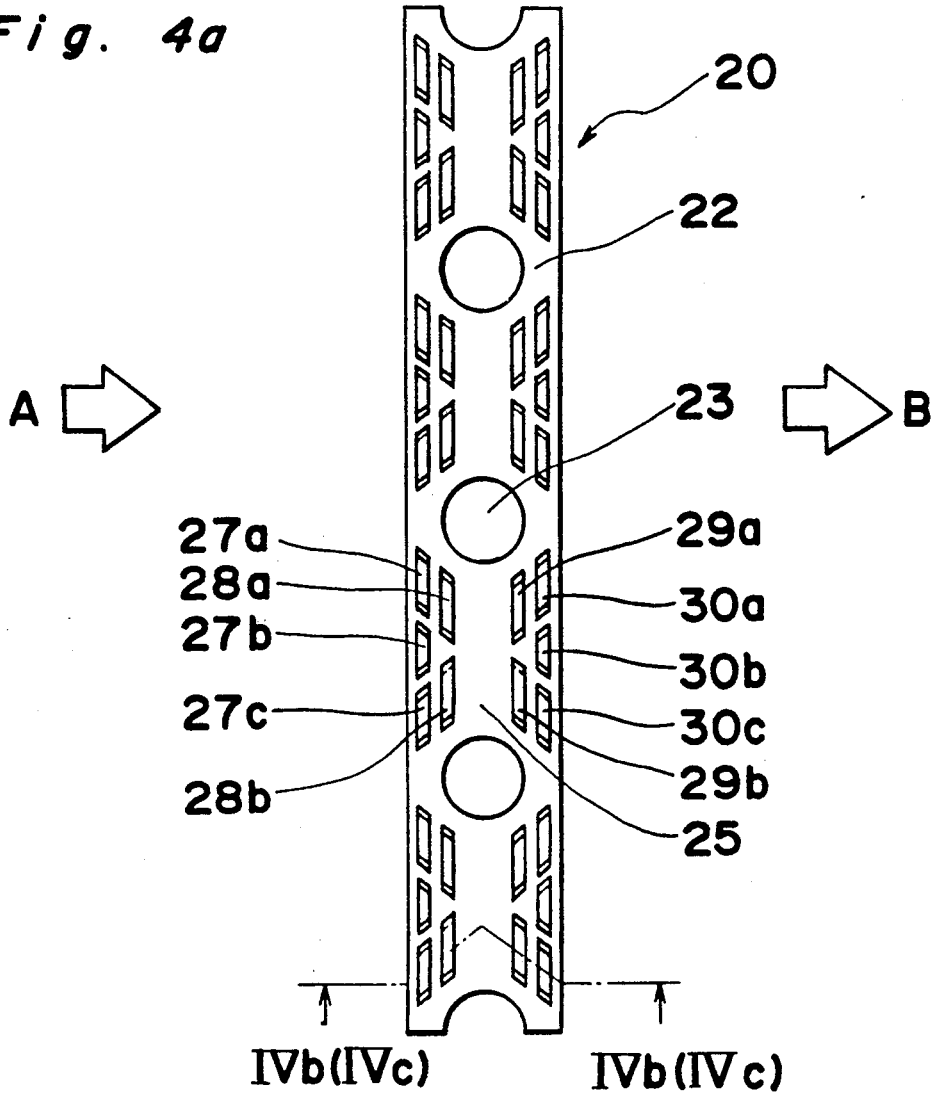
FIG. 4*a* is a front view of a fin plate according to a first embodiment of the present invention.

FIG. 4*a* depicts a fin plate 22 mounted in a fin tube heat exchanger 20 according to a first embodiment of the present invention.

As shown in FIG. 4*a*, raised strips 27*a*-27*c*, 28*a*-28*b*, 29*a*-29*b* and 30*a*-30*c* extend in a direction perpendicular to the direction of air flow shown by arrows A and B. Each raised strip has two leg portions connecting it with the fin plate 22. The leg portions of all of the raised strips are inclined with respect to the direction of air flow.

Between two adjacent heat exchanger tubes 23, the first row of strips located near an upstream edge of the fin plate 22 in the direction of air flow consists of three raised strips 27*a*-27*c*, one 27*b* in the form of a trapezoid having a long side on the upstream side of the air flow and two 27*a* and 27*c* in the form of a parallelogram and located on both sides of the raised strip 27*b* in the longitudinal direction of the fin plate 22.

The second row of strips consists of two raised strips 28*a* and 28*b* in the form of a parallelogram.

Similarly, the third row of strips consists of two raised strips 29*a* and 29*b* in the form of a parallelogram whereas the fourth strip row of strips consists of three raised strips 30*a*-30*c*, one 30*b* in the form of a trapezoid having a long side on the downstream side of the air flow and two 30*a* and 30*c* in the form of a parallelogram and located on both sides of the raised strip 30*b* in the longitudinal direction of the fin plate 22.

A draining passage 25 is formed along the center line of a row of heat exchanger tubes 23 between the second and third rows of strips.

Figure 4B:
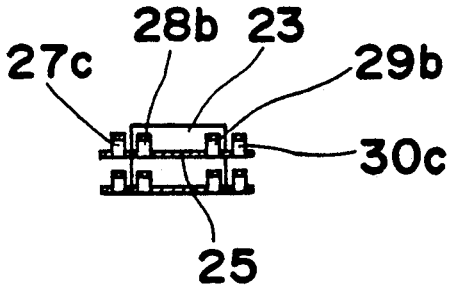
FIGS. 4*b* and 4*c* are sections taken along the lines IV*b*-IV*b* and IV*c*-IV*c* in FIG. 4*a*, respectively, illustrating two examples of the raised strips.

In the case of FIG. 4*b*, all of the raised strips 27*a*-27*c*, 28*a*-28*b*, 29*a*-29*b* and 30*a*-30*c* are formed on the same side of the fin plate 22. Accordingly, the first and second rows of strips are disposed in a symmetric relationship with the third and fourth rows of strip with respect to the center line of the row of heat exchanger tubes 23.

Figure 4C:
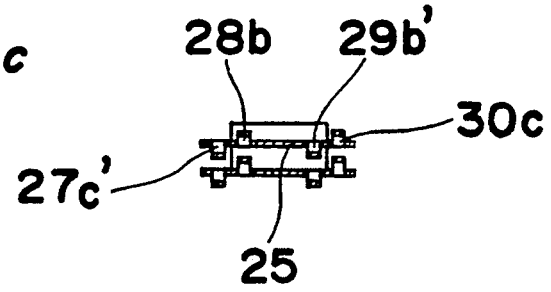

On the other hand, in the case of FIG. 4*c*, the raised strips of respective rows are formed alternately on both sides of the fin plate 22. In other words, raised strips 27*a*'-27*c*, and 29*a*'-29*b*' in the first and third rows are formed on a side of the fin plate 22 opposite to the side on which raised strips 28*a*-28*b* and 30*a*-30*c* in the second and fourth rows are formed.

In either case, although water drops are generated between adjacent raised strips, they are directed downwards along the draining passage 25 due to the following reasons:

(1) Upper surfaces of the raised strips 27*a* (27*a*') and 30*a* are located higher than those of the raised strips 28*a* and 29*a* (29*a*').

(2) The leg portions of all the raised strips 27*a* (27*a*'), 28*a*, 29*a* (29*a*') and 30*a* are inclined with respect to the air flow.

(3) The draining passage 25 is formed at the center of the fin plate 22.

Figure 5A:
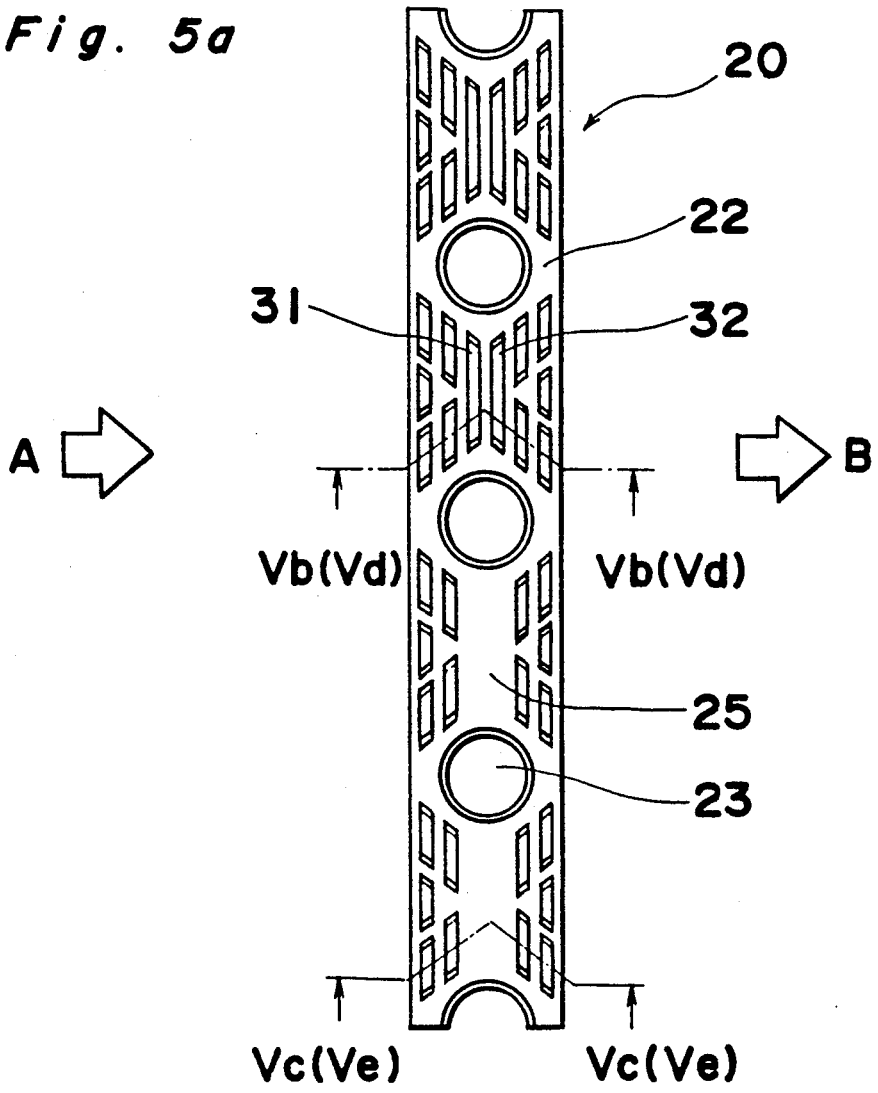
FIG. 5*a* is a front view of a fin plate according to a second embodiment of the present invention.

FIG. 5*a* depicts a fin plate 22 mounted in a fin tube heat exchanger 20 according to a second embodiment of the present invention.

Figure 5B:
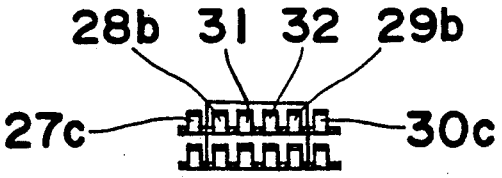
FIGS. 5*b* and 5*c* are sectional views taken along the lines V*b*-V*b* and V*c*-V*c* in FIG. 5*a*, respectively, illustrating one example of the raised strips.
Figure 5D:
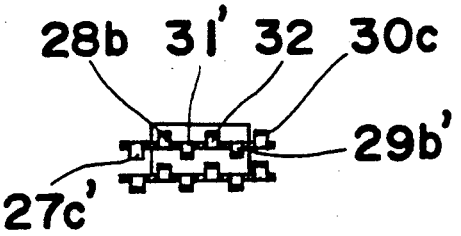
FIGS. 5*d* and 5*e* are sectional views taken along the lines Vd—Vd and Ve—Ve in FIG. 5*a*, respectively, for indicating another example of the raised strips.
Figure 5C:
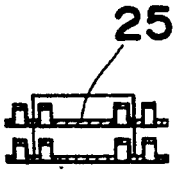
Figure 5E:
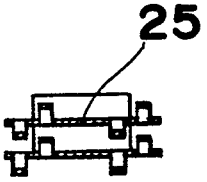

As shown in FIG. 5*a*, a plurality of raised strips are formed at regular intervals on the upper half of each fin plate 22. Two raised strips 31 and 32 in the form of a trapezoid are formed between adjacent heat exchanger tubes 23 at a location where the draining passage 25 is formed in the first embodiment. The strip pattern of the lower half of the fin plate 22 is identical with the strip pattern according to the first embodiment in which the draining passage 25 is formed at the center of the fin plate 22. All of the raised strips are formed on the same side of the fin plate 22 in the case of FIGS. 5*b* and 5*c* whereas they are formed alternately on both sides of the fin plate 22 in the case of FIGS. 5*d* and 5*e*. The reason for providing the draining passage 25 only on the lower half of the fin plate 22 is that when water drops are generated at an upper portion of the fin plate 22 and drip down, they coalesce with water drops generated at a lower portion of the fin plate 22. This fact requires wider passage for the water drops.

It is noted here that the draining passage 25 may extend along the center line of the row of the heat exchanger tubes except at a space defined between the upper two heat exchanger tubes.

Figure 6A:
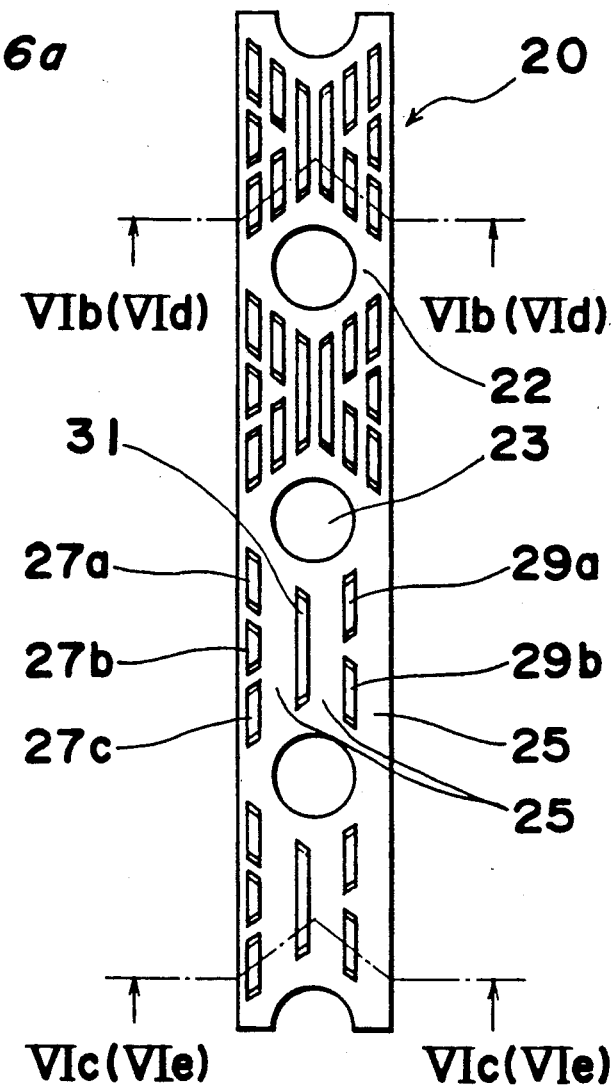
FIG. 6*a* is a front view of a fin plate according to a third embodiment of the present invention.

FIG. 6*a* depicts a fin plate 22 mounted in a fin tube heat exchanger 20 according to a third embodiment of the present invention.

Figure 6B:
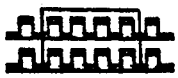
FIGS. 6*b* and 6*c* are sectional views taken along the lines VI*b*-VI*b* and VI*c*-VI*c* in FIG. 6*a*, respectively, one example of the raised strips.
Figure 6C:
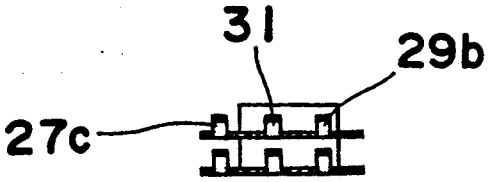
Figure 6D:
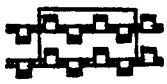
FIGS. 6*d* and 6*e* are sectional views taken along the lines VId—VId and VIe—VIe in FIG. 6*a*, respectively, illustrating another example of the raised strips.
Figure 6E:
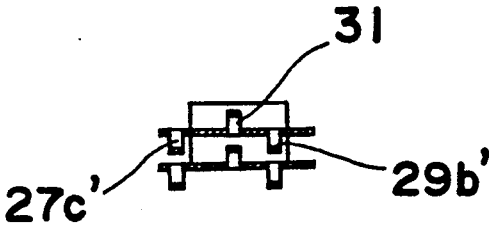

As shown in FIG. 6*a*, the strip pattern on the upper half of the fin plate 22 in this embodiment is identical with that in the second embodiment. Between two adjacent heat exchanger tubes 23 on the lower half of the fin plate 22, there are formed one raised strip 31 substantially at the center of the fin plate 22, three raised strips 27*a*–27*c* on the upstream side thereof and two raised strips 29*a*–29*b* on the downstream side thereof. The first, second and third rows of strips on the lower half correspond to the first, third and fifth rows of strips on the upper half of the fin plate 22, respectively. Accordingly, on the lower half of the fin plate 22, three draining passages 25 are formed between the first and second rows, between the second and third rows and on the downstream side of the third row in the direction of air flow. All of the raised strips may be formed on the same side of the fin plate 22 as shown in FIGS. 6*b* and 6*c*. Alternatively, they may be formed alternately on both sides of the fin plate 22 as shown in FIGS. 6*d* and 6*e*. In this embodiment, since a plurality of draining passages 25 are formed between adjacent rows of strips at a lower portion of each fin plate 22, water drops are more liable to drop from the fin plate as compared with the second embodiment. In addition, since relatively wide spaces are left between adjacent rows of strips at the lower portion of each fin plate 22, the heat exchanging performance increases due to the so-called boundary layer front-edge effect caused by the raised strips.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A fin tube heat exchanger for use in an air conditioner, said fin tube heat exchanger comprising:

a plurality of fin plates spaced at regular intervals, disposed in parallel with one another and adapted to allow air to flow therebetween;

a plurality of heat exchanger tubes arranged in at least one row and extending through said fin plates in a direction perpendicular to the planes in which said fin plates lie, said heat exchanger tubes being adapted to allow a fluid medium to pass therein;

each of said fin plates having a plurality of strips raised from the plane in which the fin plate lies so as to extend across the direction in which air is to flow between the fin plates, each of said raised strips having two leg portions inclined with respect to the direction of air flow, said raised strips being arranged in one row near a longitudinal edge of said fin plate and in another row nearer to a center line passing through the center of each of said heat exchanger tubes in the row thereof, the number of raised strips in said one row being greater than the number of raised strips in said another row, a greater number of said raised strips being provided between two adjacent ones of said heat exchanger tubes at a lower portion of each of said fin plates than between two adjacent ones of said heat exchanger tubes at an upper portion of the fin plate; and each of said fin plates having no raised strips along portions of the fin plate extending between two adjacent ones of said heat exchanger tubes in said row thereof and located to sides of said another row of raised strips, each of said portions having a width along the entireties thereof, as taken in the direction of air flow, that is substantially greater than the width of each of said raised strips whereby said portions of the fin plate constitute respective draining passages on both sides of anther row of raised strips located near the center line, and along which draining passages condensate is allowed to drip from the fin plate.

* * * * *